United States Patent [19]

Mechalas

[11] 4,252,489

[45] Feb. 24, 1981

[54] BAG OPENING APPARATUS

[76] Inventor: Emmanuel Mechalas, 2830 Townway, Danville, Ill. 61832

[21] Appl. No.: 26,832

[22] Filed: Apr. 4, 1979

[51] Int. Cl.[3] ..... B65B 69/00

[52] U.S. Cl. ..... 414/412; 414/291

[58] Field of Search ..... 414/291, 326, 412; 30/296 R, 303; 83/857; 141/330; 222/81, 86, 88

[56] References Cited

U.S. PATENT DOCUMENTS

| | | | |
|---|---|---|---|
| 2,078,599 | 4/1937 | McCauley | 414/412 |
| 2,306,426 | 12/1942 | Bundy | 414/412 |
| 2,796,184 | 6/1957 | Wilkins et al. | 414/412 |
| 3,082,922 | 6/1963 | Vitek | 414/412 X |
| 3,145,858 | 8/1964 | Helbig | 414/412 |
| 3,171,449 | 3/1965 | Ellms et al. | 414/412 X |
| 3,606,057 | 9/1971 | June | 414/412 |

*Primary Examiner*—Johnny D. Cherry
*Attorney, Agent, or Firm*—Neal J. Mosely

[57] ABSTRACT

A novel bag opening apparatus comprises an enclosure or chute or slide for receiving a bag and having bag-opening stationary knives positioned therein. The bag-opening knives comprise a plurality of knives meeting at a sharp point and extending diagonally outward to engage and be supported on the side walls of the enclosure or chute or slide. The arrangement of the knives is such that the point where the knives join is operable to puncture the end of a bag pressed there against and the knives extending diagonally outward toward the walls of the enclosure or chute or slide will make diagonal cuts in the end of a bag pressed there against which extend substantially across the end of the bag and produce an enlarged opening therein. This bag opening apparatus is designed for opening bags containing particulate material and more particularly pulverulant material. The apparatus is particularly useful in combination with dust collecting means and with auger or circulating air-type conveyor systems.

3 Claims, 7 Drawing Figures fig. 6
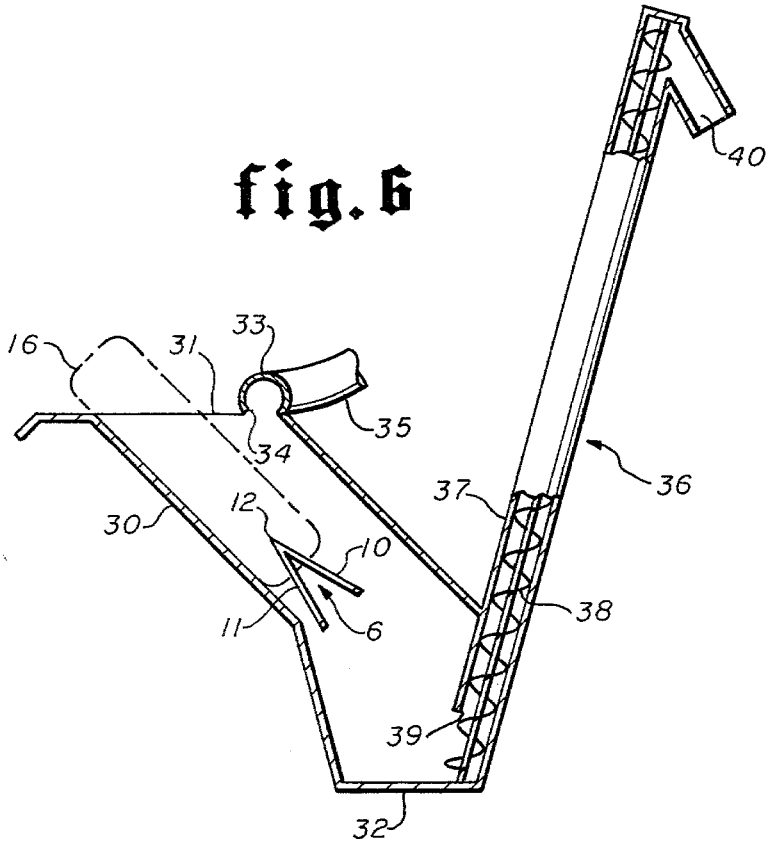
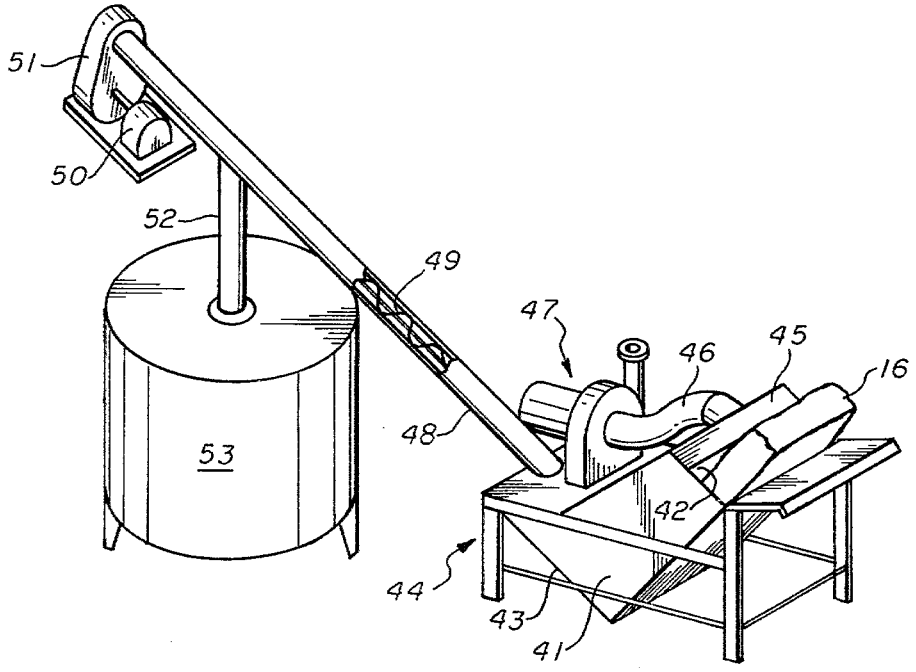
fig. 7

BAG OPENING APPARATUS

BACKGROUND OF THE INVENTION

1. Field of the Invention

This invention relates to new and useful improvements in bag opening apparatus and more particularly to bag opening apparatus for bags of particulate or pulverulant materials.

2. Brief Description of the Prior Art

In the past, bags of particulate, powdered or pulverulant materials have presented problems in handling and particularly in the opening of the bags for discharge of the materials for further processing. Such bags have usually been opened by opening an end closure or in some cases by making knife cuts along the length of the bag so that the material can be dumped out into a container or conveyor for further processing and handling.

The opening of bags of solid particulate material has usually been accompanied by a considerable amount of dust and waste arising from the opening and emptying of the bags. There is particularly a serious problem in connection with wastes and dust when a bag is held over a receptacle or the like and cut open to empty the contents. As a result, there has been a substantial need for a suitable enclosure or chute or slide for guiding particulate material to a point of further use or processing which enclosure or chute or slide includes suitable means for opening a bag of particulate or pulverulant material for emptying the contents thereof.

SUMMARY OF THE INVENTION

It is one object of this invention to provide a new and improved bag opening apparatus.

Another object of this invention is to provide an improved bag opening apparatus including means for guiding and directing flow of the contents of the opened bag.

Still another object of this invention is to provide an improved bag opening apparatus having stationary knife means for opening one end or side of the bag.

Still another object of this invention is to provide an improved bag opening apparatus having a plurality of knives arranged to cut open the entire end or side of a bag for emptying the contents therefrom.

Still another object of this invention is to provide an improved bag opening apparatus having a plurality of stationary knives for opening a bag inserted therein and provided therewith conveyor means for transporting the contents of the bag being opened.

Other objects and features of this invention will become apparent from time to time throughout the specification and claims as hereinafter related.

A bag opening apparatus accomplishing the aforementioned objectives is described herein.

A novel bag opening apparatus comprises an enclosure or chute or slide for receiving a bag and having bag-opening stationary knives positioned therein. The bag-opening knives comprise a plurality of knives meeting at a sharp point and extending diagonally outward to engage and be supported on the side walls of the enclosure or chute or slide. The arrangement of the knives is such that the point where the knives join is operable to puncture the end of a bag pressed there against and the knives extending diagonally outward toward the walls of the enclosure or chute or slide will make diagonal cuts in the end of a bag pressed there against which extend substantially across the end of the bag and produce an enlarged opening therein. This bag opening apparatus is designed for opening bags containing particulate material and more particularly pulverulant material. The apparatus is particularly useful in combination with dust collecting means and with auger or circulating air-type conveyor systems.

BRIEF DESCRIPTION OF THE DRAWINGS

FIG. 6 is a side view partially in section of another embodiment of the invention provided with dust collector means and an auger conveyor.

FIG. 7 is an isometric view of this bag opener apparatus combined in a conveyor assembly for transportation of the bag contents to a processing vessel.

DESCRIPTION OF THE PREFERRED EMBODIMENTS

Figure 1:
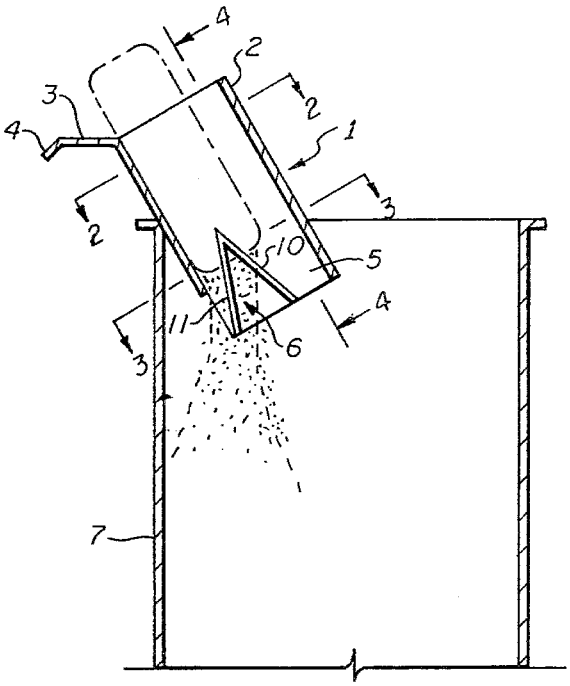
FIG. 1 is a side view, in longitudinal section, of one embodiment of this bag opening apparatus.

Referring to the drawings by numerals of reference, and more particularly to FIGS. 1–4, there is shown a bag opening apparatus which is a preferred embodiment of this invention. The bag opening apparatus 1 consists of an enclosed chute or hopper 2 having an open top end 3 with a handle 4 extending therefrom. The bottom end of hopper 2 is open as indicated at 5 and has an assembly 6 of knives supported therein for puncturing and opening the contents of a bag 16 positioned in the apparatus. On opening, the contents of bag 16 fall into vessel 7 for storage or transportation or processing.

Figure 2:
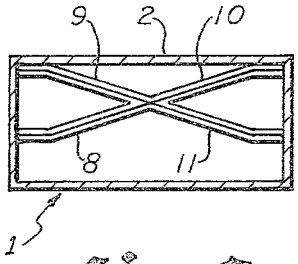
FIG. 2 is a sectional view taken on the line 2—2 of FIG. 1.
Figure 3:
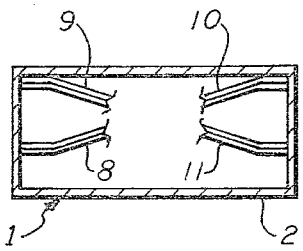
FIG. 3 is a sectional view taken on the line 3—3 of FIG. 1 and showing the bag opening knives in more detail.
Figure 4:
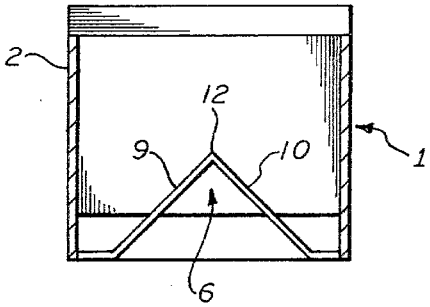
FIG. 4 is a sectional view taken on the line 4—4 of FIG. 1.

Knife assembly 6 comprises a plurality of stationary knife blades 8, 9, 10 and 11 which extend diagonally within hopper or chute 2 as seen in end view or in the sectional view shown in FIGS. 2 and 3. The knife blades are secured together in a sharp point 12 and extend diagonally in a direction generally longitudinal of hopper chute 2. Each of the stationary knives is secured to one of the walls of hopper or chute 2, as indicated. The upper edges of the stationary knife blades are relatively sharp knife edges and said knife edges meet in a sharp point 12 where the knife blades are joined together. This knife assembly, therefore, consists of a plurality of stationary knife blades having sharp knife edges meeting in a sharp point, with the knife blades extending diagonally in a direction both longitudinal and lateral of the chute or hopper 2. The knife blades which are three or more in number are shown to be preferably four in number in the drawings illustrating the preferred embodiment. The knife blades are noncoplanar in layout and are effective to engage the end or side of a bag pushed into the chute or hopper 2. When the bag is pushed against the end of the knife assembly, the knife point 12 first penetrates the wall of the bag and the diagonally extending knife blades slice open the bag end or side diagonally across the entire length of the end or side of the bag. As a result, the end or side of the bag is completely sliced open in diagonal cuts and the material of the bag is free to open wide and the contents of the bag drop out through the hopper or chute 2 past the stationary blade assembly and through the open end 5 into the container or hopper or conduit 7.

The embodiment of the invention just shown is one in which the bag-opening knife assembly is supported on and carried in a chute or hopper or slide which is portable and moveable from one container to another where a bag is to be opened and the contents emptied therein. It is obvious, that the bag-opening knife assembly may be used in other means or apparatus for storing or transporting or processing the contents of the bag being opened. Several additional embodiments of the invention illustrating the application of the novel bag-opening knife assembly are described below and are illustrated in FIGS. 5 to 7.

AN ALTERNATE EMBODIMENT

Figure 5:
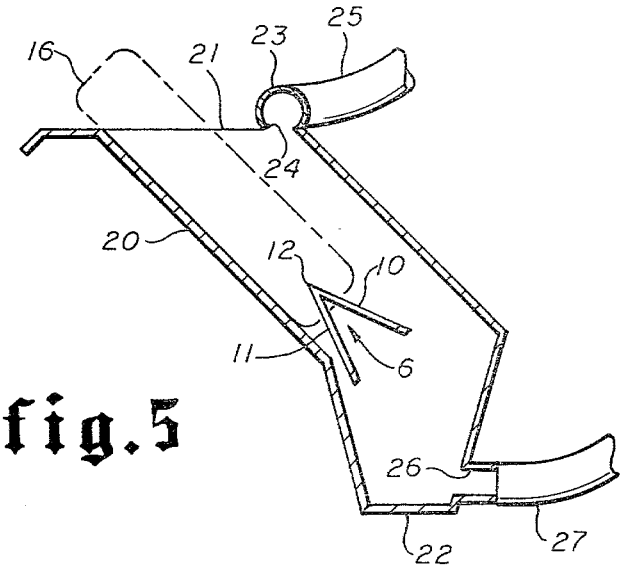
FIG. 5 is a side view, partially in section, of an alternate embodiment of the invention which includes a pump or air conveyor in combination with the bag opening apparatus.

In FIG. 5, there is shown an alternate embodiment of the invention wherein the novel bag-opening knife assembly is utilized in apparatus including dust collector and transporting or conveying connections. In this embodiment, there is provided a hopper 20 having an open top end 21 and closed bottom end 22. Adjacent top end 21, there is provided a tube 23 having a bottom slot 24 extending along the top edge of hopper 20. Slotted tube 23 is connected by conduit 25 to a remote dust collector unit which draws away dust-laden air from hopper 20 to prevent the emission of undesirable amounts of dust into the air space where the equipment operators are working. The bottom end of hopper 22 has an outlet opening 26 which is connected by conduit 27 to a pump or air-conveyor (not shown).

In this embodiment, knife assembly 6 is supported in hopper 20, as shown, and has the same shape and arrangement of knife blades as in FIGS. 1–4. In this embodiment, when bag 16 is placed in hopper 20 and pushed against the pointed end 12 of knife blades 8–11 the end of the bag is punctured first at the center and then sliced open diagonally across the entire end face so that the contents of the bag fall past knife assembly 6 into the bottom of hopper 20 and are conveyed away through conduit 27.

ANOTHER EMBODIMENT OF THE INVENTION

In FIG. 6, there is shown another embodiment of the invention wherein the novel stationary bag-opening knife assembly is used in a hopper equipped with an auger conveyor for transporting contents to another location. In FIG. 6, the hopper 30 has an open top end 31 and closed bottom end 32. Along the back edge of top end 31 there is supported to a tube 33 having a slotted bottom opening 34. Slotted tube 33 is connected by conduit 35 to a dust collector unit (not shown). An auger conveyor 36 consisting of tube 37 and auger 38 extends into the bottom of hopper 32 and has an open bottom end 39 positioned to receive the contents emptied from a bag into the apparatus. The top end of tube 37 has an outlet tube 40 for discharging the contents to a conduit or to another vessel for transportation, storage or further processing. In this embodiment, the bag-opening knife assembly 6 is supported in hopper 30 in the same relationship as in the other embodiments. In this embodiment, bag 16 is pushed into hopper 30 against the pointed end of bag-opening knife assembly 6. The pointed end 12 of knife assembly 6 penetrates the end of bag 16 and the knife blades slice open the end of the bag diagonally to the full width of the bag to provide a wide opening to dump the contents of the bag into the bottom portion 32 of hopper 30. The dust collector connection at the top of hopper 30 conveys away dust-laden air from the apparatus to prevent the emission of dust at undesirable levels around the operators of the equipment. The auger conveyor is effective to move the particulate solid matter from bag 16 away from the bottom of the hopper to be discharged through tube 40 to another selected location.

STILL ANOTHER EMBODIMENT

In FIG. 7, there is shown a complete bag-opening and conveyor assembly in association with a processing vessel. In this embodiment, the internal details of construction of the apparatus are not shown but are substantially as illustrated in FIGS. 1–6.

In FIG. 7, there is shown a hopper 41 having an open top end 42 and closed bottom end 43. Hopper 41 is supported in a rectangular supporting frame 44. At the top end 42 of hopper 41 there is provided a slotted dust collector tube 45 connected by conduit 46 to a conventional centrifugal dust collector unit 47. The bottom of hopper 41 has a tube 48 and auger 49 extending therein to remove from the bottom of hopper 41 the contents of bag 16 when opened. Auger 49 is operated by motor 50 and gear assembly 51. Tube 52 which extends downward from auger tube 48 opens into the top of container 53 which may be a storage vessel or a processing vessel. Hopper 41 is provided with a bag-opening knife assembly 6 positioned in the same relative location as in the other embodiments of the invention.

OPERATION

While the general operation of this apparatus has already been described, it will be repeated here for emphasis. In each of the several embodiments of the invention, bag-opening stationary knife assembly 6 is provided to open bag 16 when pushed endwise or sidewise into the hopper or chute or slide. When bag 16 engages the sharp point 12 or knife assembly 6, the end or side or edge of the bag is first penetrated by point 12 and the end or side edge of the bag is sliced open by the diagonally extending stationary knives. The diagonally extending stationary knives are effective to make diagonal cuts across the entire width and length of the bag so that the bag is fully opened to dump the contents rapidly and completely into the hopper or slide or chute. This knife assembly functions to open a bag very rapidly and thoroughly so that the contents may be quickly dumped and moved to another location for further storage or processing. In the embodiment shown in FIG. 1, the bag-opening knife assembly is supported in a portable hopper or chute or slide for emptying the contents of bags into open top containers. In the embodiments shown in FIGS. 5–7 the bag-opening knife assembly is positioned in and combined with hoppers or slides or chutes which are provided with dust collector connections and also with a suitable conveyor means, such as an auger conveyor or a pump or air conveyor. The apparatus, as described above, is effective to open bags quickly and thoroughly and to dump the contents completely into a hopper and provides in several embodiments for rapid conveying of the particulate solid matter dropped from the bag and also provides for collection and removal of dust for the protection of the workers in the area of the equipment.

While this invention has been described fully and completely with special emphasis upon several preferred embodiments it should be understood that within the scope of the appended claims the invention may be practiced otherwise than as specifically described herein.

I claim:

1. A bag opener apparatus comprising means forming an open ended chute, an assembly of at least three stationary knives supported in said chute, said knives meeting in a common sharp point and extending diagonally laterally and longitudinally of said chute in a non-coplanar relation, a slotted tube extending along at least one edge of the open end of said chute with the slot open to the interior of said chute, and a conduit connected to one end of said slotted tube and to air exhaust means comprising dust collector means.

2. A bag opener apparatus according to claim 1 in which said chute includes conveyor means positioned below said knife assembly to remove therefrom the contents of a bag opened by pressing against the pointed end and cutting edges of said knife assembly.

3. A bag opener apparatus according to claim 1 in which said chute comprises a hopper having a closed bottom end and a conveyor comprising a tube and auger extending into said closed bottom end at a location below said knife assembly for removing therefrom the contents of a bag opened by pressing against the pointed end and cutting edges of said knife assembly.

* * * * *